US005813316A

United States Patent [19]

Sekiya et al.

[11] Patent Number: 5,813,316

[45] Date of Patent: Sep. 29, 1998

[54] ROTARY HYDRAULIC ACTUATOR

[75] Inventors: Mutsuo Sekiya, Tokyo; Katsuyuki Fukuhara, Kobe; Masafumi Sugawara, Tokyo, all of Japan

[73] Assignee: Mitsubishi Denki Kabushiki Kaisha, Tokyo, Japan

[21] Appl. No.: 822,755

[22] Filed: Mar. 24, 1997

[30] Foreign Application Priority Data

Oct. 8, 1996 [JP] Japan ..... 8-267604

[51] Int. Cl.[6] ..... F01C 9/00

[52] U.S. Cl. ..... 92/121; 92/125; 92/170.1; 277/165

[58] Field of Search ..... 92/120, 121, 122, 92/123, 124, 125, 170.1; 277/165

[56] References Cited

U.S. PATENT DOCUMENTS

| | | | |
|---|---|---|---|
| 3,554,096 | 1/1971 | De Jager | 92/170.1 |
| 4,042,747 | 8/1977 | Breton et al. | 428/323 |
| 4,474,105 | 10/1984 | Eicher et al. | 92/122 |
| 4,611,530 | 9/1986 | Stoll et al. | 92/125 |
| 4,784,047 | 11/1988 | Stoll et al. | 92/122 |
| 4,817,504 | 4/1989 | Lieberman | 92/125 |
| 5,332,236 | 7/1994 | Kastuhara et al. | 92/125 |
| 5,701,799 | 3/1996 | Granberg | 92/121 |

FOREIGN PATENT DOCUMENTS

| | | |
|---|---|---|
| A-7-238815 | 9/1995 | Japan . |
| A-7-259516 | 10/1995 | Japan . |

*Primary Examiner*—Thomas E. Denion

*Attorney, Agent, or Firm*—Sughrue, Mion, Zinn, Macpeak & Seas, PLLC

[57] ABSTRACT

In a rotary hydraulic actuator wherein a hermetic casing has the inside divided into a first hydraulic chamber and a second hydraulic chamber by a vane slidably rotatable on an inner curved wall of the casing, the vane is rotatable by an oil pressure supplied to the respective chambers, and the movement of the vane is taken out from an output shaft, the inner wall of the casing which is in sliding contact with the vane is formed with a polytetrafluoroethylene sliding member.

7 Claims, 6 Drawing Sheets

ROTARY HYDRAULIC ACTUATOR

BACKGROUND OF THE INVENTION

1. Field of the Invention

The present invention relates to a rotary hydraulic actuator wherein the rotational angle of an output shaft is changed and held at a desired position with high precision, and which is suitable to e.g. a driving source for controlling the opening and closing timing of an intake or exhaust valve of an internal combustion engine.

2. Discussion of Background

In FIGS. 9 and 10, there are shown a schematic structure of a conventional rotary hydraulic actuator and a driving process therefor. In these Figures, Reference numeral 1 designates a hermetic casing having a substantially semicircular cross section, reference numeral 2 designates an output shaft, and reference numeral 3 designates a rotary member which is coupled with the output shaft 2 in a one-piece construction. Reference numeral 4 designates a vane which has one end inserted into or integrally coupled with a peripheral portion of the rotary member 3, and which has the other end in slidable contact with an inner surface of the casing 1. Reference numeral 5 designates a first hydraulic chamber which is defined by casing 1, the rotary member 3 and the vane 4. Reference numeral 6 designates a second hydraulic chamber which is defined like the first hydraulic chamber so as to be opposite to the first hydraulic chamber 5. Reference numeral 7 designates a first port for oil intake into and oil exhaust from the first hydraulic chamber 5. Reference numeral 8 designates a second port for oil intake into and oil exhaust from the second hydraulic chamber 6. Reference numeral 9 designates a four port three position switching solenoid operated hydraulic controlled valve which electrically controls oil supply into and oil exhaust from the first and second hydraulic chambers. Reference numeral 10 designates an oil pump for oil supply into the hydraulic actuator. Reference numeral 11 designates an oil reservoir. Reference numeral 12 designates a return pipe for returning the oil exhausted from the hydraulic controlled valve 9 to the oil reservoir. Reference numeral 13 designates bearings for rotatably supporting the output shaft 2. Reference numeral 14 designates an oil seal ring for preventing the oil from leaking out of a portion of the casing through which the output shaft 2 projects. The hydraulic controlled valve 9 has a port 9*a* connected to the oil pump 10, a port 9*b* connected to the first hydraulic chamber 5, a port 9*c* connected to the second hydraulic chamber 6 and a port 9*d* connected to the oil reservoir 11.

Now, the operation of the conventional rotary hydraulic actuator will be explained. The rotary hydraulic actuator is rotatable about the rotary shaft 2 in the direction indicated by a solid line arrow or a dotted line arrow in FIG. 9. First, when the hydraulic controlled valve 9 is controlled so that the ports 9*a* and 9*b* communicate each other, the oil pressurized and supplied by the oil pump 10 is supplied to the first hydraulic chamber 5 and simultaneously the oil in the second hydraulic chamber 6 is exhausted into the reservoir 11 through the hydraulic controlled valve 9 because the ports 9*c* and 9*d* communicate each other due to shift of a spool valve of the hydraulic controlled valve 9 not shown. In that state, the pressure in the first hydraulic chamber 5 becomes greater than that in the second hydraulic chamber 6 to create a pressure difference between both hydraulic chambers 5 and 6. Such a pressure difference turns the vane 4 in the direction of the solid line arrow in FIG. 9 to rotate the rotary member 3 and the output shaft 2.

When the spool valve in the hydraulic controlled valve 9 is controlled so that the ports 9*a* and 9*c* communicate each other, the oil pressurized and supplied by the oil pump 10 is supplied to the second hydraulic chamber 6 and simultaneously the oil in the first hydraulic chamber 5 is exhausted to the reservoir 11 through the hydraulic controlled valve 9 because the ports 9*b* and 9*d* in the hydraulic controlled valve 9 communicates each other. In that state, the pressure in the second hydraulic chamber 6 becomes greater than that in the first hydraulic chamber 5 to create a pressure difference between both hydraulic chambers 5 and 6 in the reverse direction, thereby rotating the rotary member 3 and the output shaft 2 in the direction of the dotted line arrow in FIG. 9.

When the ports 9*b* and 9*c* are closed by the spool valve in the hydraulic controlled valve 9 not shown, the oil pressure in both hydraulic chambers 5 and 6 are kept equal, and the output shaft 2 stops rotating and is held at that position.

In the conventional rotary hydraulic actuator thus constructed, sealing measures to restrain an increase in sliding friction as well as to obtain good sealing performance are required since the outer end of the vane 4 carried on the rotary member 3 slidably moves in the casing 1.

SUMMARY OF THE INVENTION

It is an object of the present invention to solve this problem of the conventional hydraulic actuator as stated above and to provide a highly efficient hydraulic actuator.

The present invention provides a rotary hydraulic actuator comprising a hermetic casing having an inner curved wall formed therein; a vane slidably rotatable on the inner curved wall and dividing the inside of the casing into a first hydraulic chamber and a second hydraulic chamber; the respective chambers having a hydraulic working fluid supplied therein to rotate the vane and to generate movement on the vane, an output shaft for taking out the movement of the vane, and a sliding member made of fluoroelastomer or polytetrafluoroethylene resin and arranged at a slidable contacting portion between the inner curved wall and the vane.

The sliding member may be a polytetrafluoroethylene resin member formed on a slidable portion of the inner curved wall which is in slidable contact with the vane.

The sliding member may be a sealing member made of fluoroelastomer or polytetrafluoroethylene resin formed on a slidable portion of the vane which is in slidable contact with the inner curved wall.

The sealing member may be a mesh cord shaped sealing member having polytetrafluoroethylene resin immersed therein and inserted into a sealing groove formed on a peripheral portion of the vane.

The sealing member may be a plate shaped sealing member having polytetrafluoroethylene resin immersed therein and attached on one or opposite surfaces of the vane.

The sealing member may cover the glidable portion of the vane which is in slidable contact with the inner curved wall, and includes, in proximity to the slidable portion, a thin skirt shaped projection which is formed to extend substantially along the inner curved wall.

The sealing member may be formed in a bag so as to be put on the vane.

The sealing member may be formed with a vane body in a one-piece construction by insert molding.

In accordance with the present invention, the provision of the polytetrafluoroethylene sliding member on the inner curved wall can restrain oil leakage in the vicinity of the vane without an increase in sliding friction with the vane, and obtain a rotary hydraulic actuator having high performance.

Attachment of the polytetrafluoroethylene fabric sealing member onto the vane can restrain oil leakage in the vicinity of the vane and offer an advantage in that it is easy to exchange a used sealing member with a new sealing member.

The provision of the skirt shaped projection at a peripheral portion of the sealing member can further improve sealing performance at the time of applying an oil pressure.

DESCRIPTION OF THE PREFERRED EMBODIMENTS

EMBODIMENT 1

Figure 1:
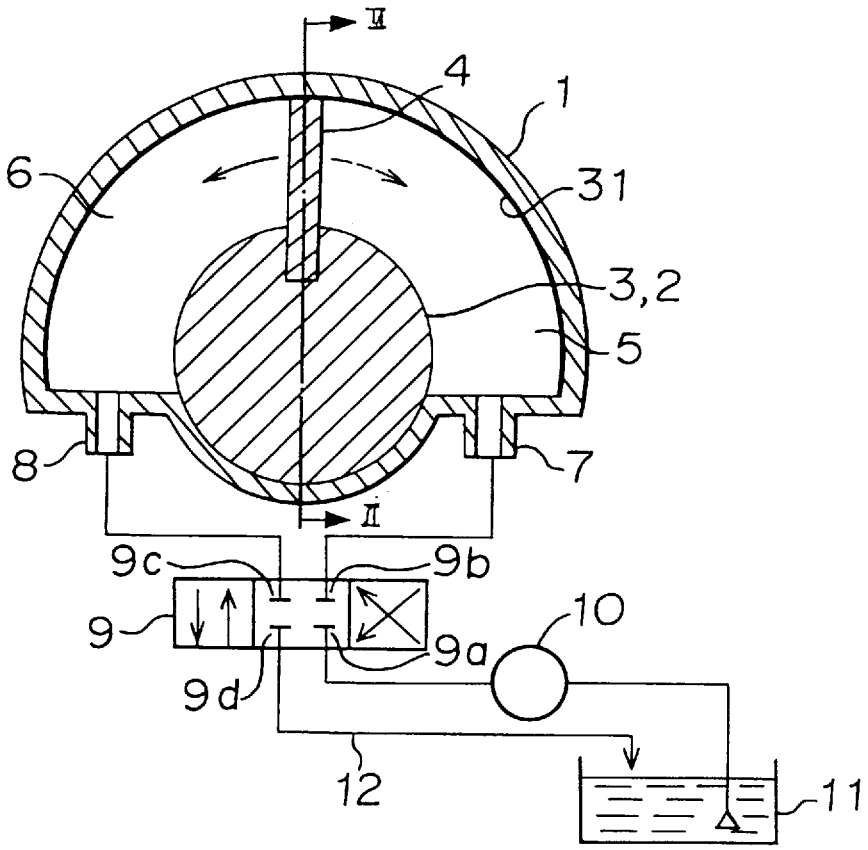
FIG. 1 is a cross-sectional view of the rotary hydraulic actuator according to a first embodiment of the present invention.
Figure 2:
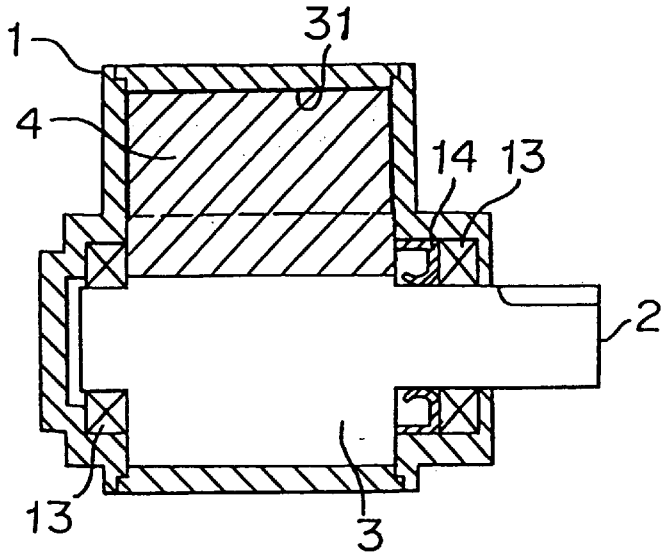
FIG. 2 is a cross-sectional view taken along the line II—II of FIG. 1.

In FIGS. 1 and 2, there is shown the rotary hydraulic actuator according to a first embodiment of the present invention. Reference numeral 1 designates a casing having a substantially semi-circular cross section. Reference numeral 2 designates an output shaft. Reference numeral 3 designates a rotary member which is coupled with the output shaft 2 in a one-piece construction and which is housed in the casing 1. Reference numeral 4 designates a vane which has one end inserted or integrally coupled with an outer peripheral portion of the rotary member 3, and which has the other end in slidable contact with an inner surface of the casing 1. Reference numeral 5 designates a first hydraulic chamber which is defined by the casing 1, the rotary member 3 and the vane 4. Reference numeral 6 designates a second hydraulic chamber which is defined like the first hydraulic chamber 5 so as to be opposite to the first hydraulic chamber 5. Reference numeral 7 designates a first port for oil intake into and oil exhaust from the first hydraulic chamber 5. Reference numeral 8 designates a second port for oil intake into and oil exhaust from the second hydraulic chamber 6. Reference numeral 9 designates a four port three position switching solenoid operated hydraulic controlled valve which electrically controls oil supply to and oil exhaust from the first and second hydraulic chambers. Reference numeral 10 designates an oil pump for oil supply to the hydraulic actuator. Reference numeral 11 designates an oil reservoir. Reference numeral 12 designates a return pipe for returning the oil exhausted from the hydraulic controlled valve 9 to the reservoir 11. Reference numeral 13 designates bearings for rotatably supporting the output shaft 2. Reference numeral 14 designates an oil sealing ring for preventing the oil from leaking out of a portion of the casing, through which the output shaft 2 projects.

The hydraulic controlled valve 9 has a port 9*a* connected to the oil pump 10, a port 9*b* connected to the first hydraulic chamber 5, a port 9*c* connected to the second hydraulic chamber 6 and a port 9*d* connected to the reservoir 11. Reference numeral 31 designates a sliding member which is formed on a slidable portion of the casing which is in slidable contact with the vane 4, and which is formed by baking e.g. polytetrafluoroethylene resin on the inner surface of the casing 1.

Although the rotary hydraulic actuator drives the output shaft in the same manner as the conventional one, the provision of the sliding member 31 at the portion of the casing 1 which is in slidable contact with the vane 4 can reduce sliding friction between the casing 1 and the vane 4 during rotation of the rotary member 3, and minimize a gap between the casing and the vane to improve sealing performance without an increase in sliding friction. As a result, even a minute pressure applied to a hydraulic chamber can be accurately taken out as movement of the output shaft.

EMBODIMENT 2

Figure 3:
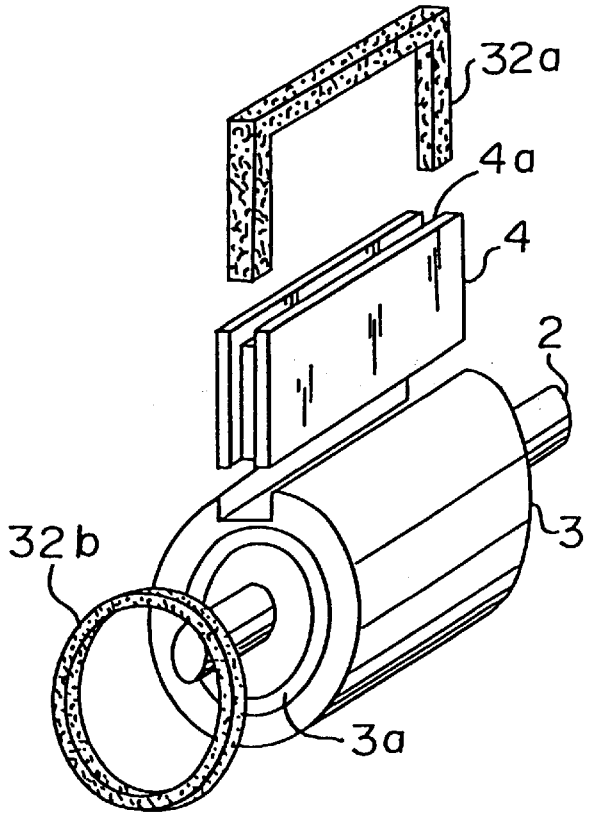
FIG. 3 is an exploded perspective view of a sealing structure of the rotary hydraulic actuator according to a second embodiment of the present invention.

Although in the first embodiment the sliding member is arranged on the inner wall of the casing, in a second embodiment the vane 4 of the rotary hydraulic actuator is provided with special sealing means, the structure of which is shown in FIG. 3. In FIG. 3, there is shown the rotary member and its attachments according to the second embodiment as an exploded perspective view. In FIG. 3, Reference numeral 4 designates a vane which has a base portion coupled to the rotary member 3. Reference numeral 4*a* designates a sealing groove which is formed on an upper end surface and opposite side end surfaces of the vane 4. Reference numeral 32*a* designates a sealing member which is inserted into the sealing groove 4*a*, which is made of mesh cord material having polytetrafluoroethylene resin immersed therein, e.g. aramide fiber (trademark Kevlar) -mesh cord material, polytetrafluoroethylene fiber-mesh cord material or carbon fiber-mesh cord material, and which forms a slidable contacting surface with the inner wall of the casing 1 which is constructed in a semi-circular and hermetic manner. Reference numeral 3*a* designates a circular groove which is formed on each side surface of the rotary member 3. Reference numeral 32*b* designates a sealing member which is made of mesh cord material, and which is inserted into the groove 3*a* to prevent the oil from leaking at each end in the axial direction of the rotary member.

Although the vane 4 contacts the inner wall of the casing 1 with the slidable contacting surface made of such mesh cord material sealing member, it is possible to improve sealing performance without an increase in sliding friction at the sealing portion because the sealing member 32*a* has a relatively good elasticity and small sliding friction.

EMBODIMENT 3

Figure 4:
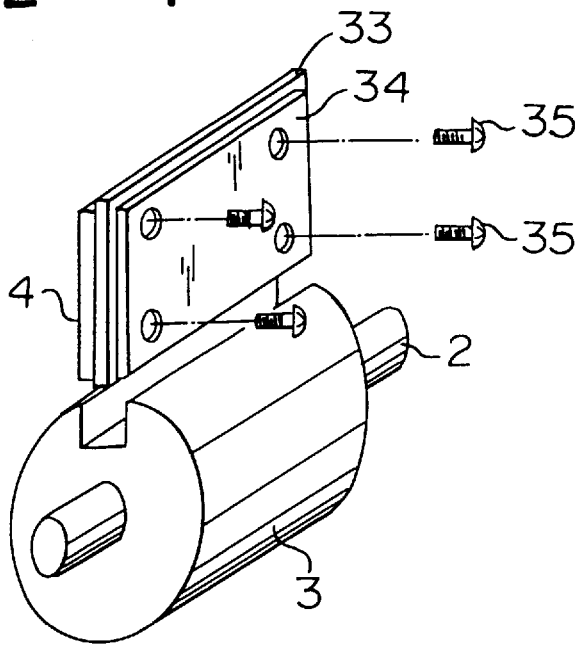
FIG. 4 is an exploded perspective view showing a sealing structure of the rotary hydraulic actuator according to a third embodiment of the present invention.

Although in the second embodiment the mesh cord shaped sealing member is provided on the vane to improve sealing performance, a plate shaped sealing material shown as a third embodiment can be used. In FIG. 4, there is shown the third embodiment. Reference numeral 4 designates a vane. Reference numeral 33 designates the plate shaped sealing member which is slightly greater than the vane 4 in width and height. Reference numeral 34 designates a fixed plate which fixes the plate shaped sealing member 33 to one side of the vane 4 by screws 35. The plate shaped sealing member is made of fiber material having polytetrafluoroethylene resin immersed therein, e.g. aramide fiber (trademark Kevlar), polytetrafluoroethylene fiber or carbon fiber. As a result, it is possible to improve sealing performance without an increase in sliding friction at the sealing portion like the second embodiment. The plate shaped sealing member may be provided on each side of the vane.

EMBODIMENT 4

Figure 5:
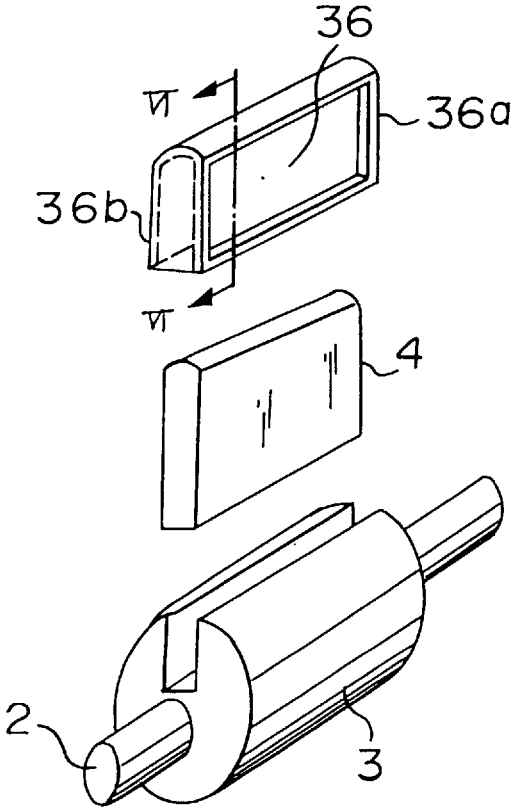
FIG. 5 is an exploded perspective view showing a sealing structure of the rotary hydraulic actuator according to a fourth embodiment of the present invention.
Figure 6:
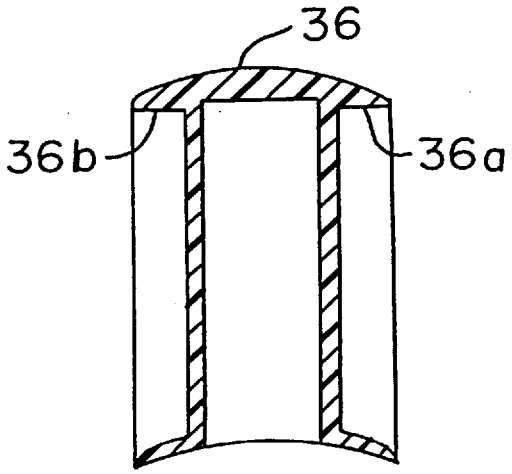
FIG. 6 is a cross-sectional view taken along the line VI—VI of FIG. 5.

Although in the second and third embodiments the mesh cord shaped or plate shaped sealing member is fixed on the vane, a bag shaped sealing member shown as a fourth embodiment can be used. In FIG. 5, there is shown the rotary member and its attachments according to the fourth embodiment as an exploded perspective view. In FIG. 6, there is shown a cross-sectional view of the sealing member according to the fourth embodiment. In the fourth embodiment, the bag shaped sealing member 36, which is made of fluoroelastomer or polytetrafluoroethylene resin, is put on the vane 4. Opposite sides of the bag shaped sealing member 36 have respective circumferential edges formed with thin skirt shaped projections 36*a*, 36*b* along the inner surfaces of the casing 1.

The sealing member 36 can decrease sliding friction and improve sealing performance between the inner wall of the casing 1 and the vane 4. In addition, when the hydraulic pressure is applied to e.g. the first hydraulic chamber 5, the skirt shaped projection 36*a* can have the oil pressure outwardly applied thereto to be deformed in a direction of decreasing the gap at the slidable contacting portion, thereby decreasing oil leakage from the vicinity of the vane. Conversely, when the oil pressure is applied to the second hydraulic chamber 6, the skirt shaped projection 36*b* can have the oil pressure outwardly applied thereto to be deformed in a direction of decreasing the gap at the slidable contacting portion, thereby decreasing oil leakage from the vicinity of the vane 4 as well.

EMBODIMENT 5

Figure 7:
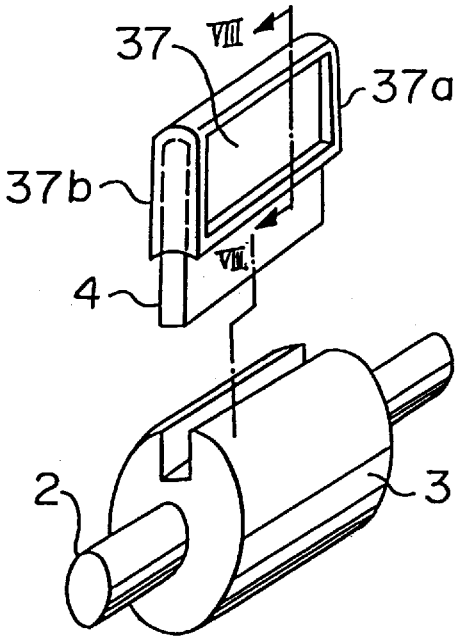
FIG. 7 is an exploded perspective view showing a sealing structure of the rotary hydraulic actuator according to a fifth embodiment of the present invention.
Figure 8:
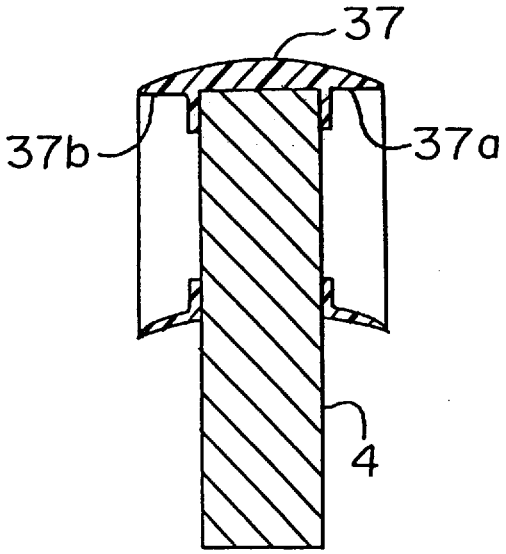
FIG. 8 is a cross-sectional view taken along the line VIII—VIII of FIG. 7.
Figure 9:
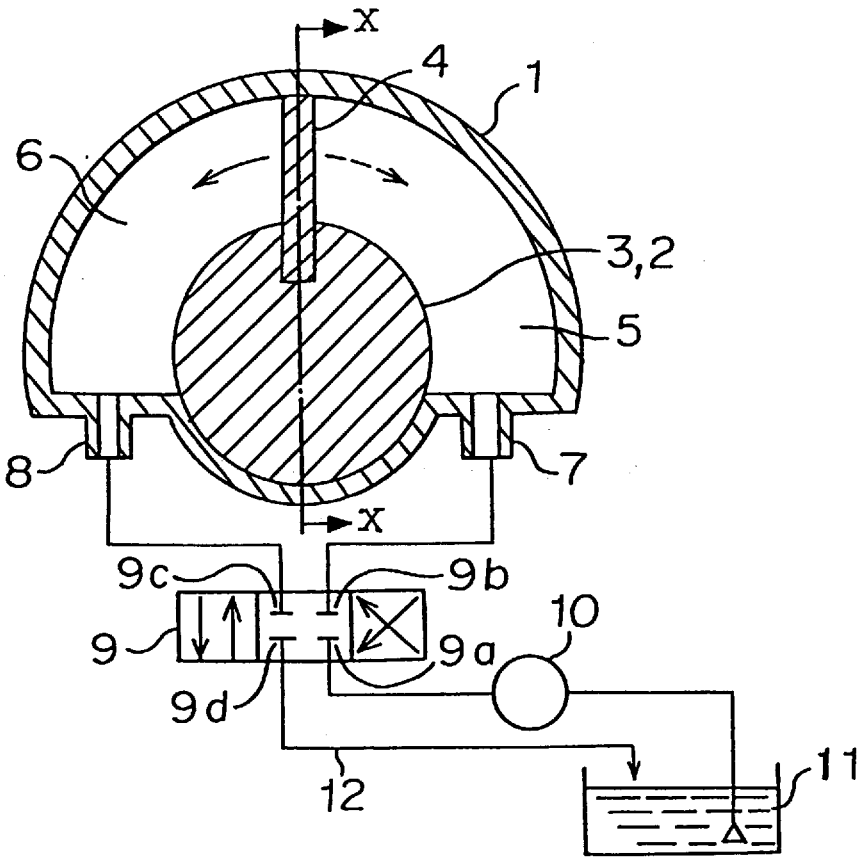
FIG. 9 is a cross-sectional view of a conventional rotary hydraulic actuator.
Figure 10:
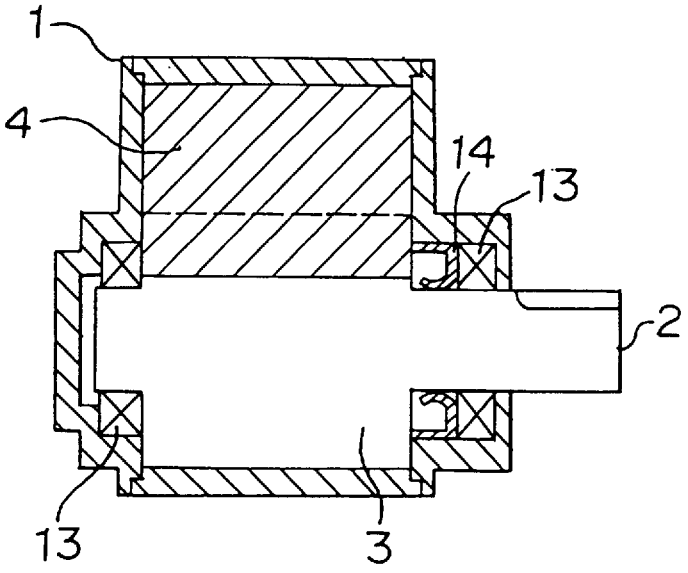
FIG. 10 is a cross-sectional view taken along the line X—X of FIG. 9.

Although in the fourth embodiment the bag shaped sealing member is put on the vane 4, in a fifth embodiment a sealing member and a vane are formed in a one-piece construction. In FIG. 7, there is shown the fifth embodiment. A portion of the vane 4 which works as the slidable contacting portion has a sealing member 37 of fluoroelastomer or polytetrafluoroethylene resin formed therewith in a one-piece construction by insert molding of a vane body. And opposite sides of the sealing member have respective circumferential edges formed with thin skirt shaped projections 37*a*, 37*b* along the inner surface of the casing 1. The projections 37*a*, 37*b* are deformable in the direction of decreasing the gap at the slidable contacting portion and can decrease oil leakage from the vicinity of the vane 4 like the fourth embodiment shown in FIG. 5. In FIG. 8, there is shown the vane 4 according to the fifth embodiment as a cross-sectional view.

Obviously, numerous modifications and variations of the present invention are possible in light of the above teachings. It is therefore to be understood that within the scope of the appended claims, the invention may be practiced otherwise than as specifically described herein.

What is claimed is:

1. A rotary hydraulic actuator comprising:

a hermetic casing having an inner curved wall formed therein;

a rotary member housed in said casing;

an output shaft integrally formed with said rotary member;

a vane slidably rotatable on said inner curved wall and dividing the inside of said casing into a first hydraulic chamber and a second hydraulic chamber, wherein said vane has a flat shape and has one end coupled with an outer peripheral portion of said rotary member;

said first and second hydraulic chambers having a hydraulic working fluid supplied therein to cause rotation of said vane and thereby transfer torque to said output shaft; and a sliding member made of fluoroelastomer or polytetrafluoroethylene resin and coated on a slidable contacting portion of said inner curved wall by baking.

2. A rotary hydraulic actuator according to claim 1, wherein said sliding member is a sealing member including fluoroelastomer or polytetrafluoroethylene resin formed on a slidable portion of said vane which is in slidable contact with the inner curved wall, the sealing member is a mesh cord shaped sealing member made of intertwined strands with polytetrafluoroethylene resin immersed therein, and the sealing member is inserted into a sealing groove formed on a peripheral portion of said vane.

3. A rotary hydraulic actuator according to claim 2, wherein the sealing member is a plate shaped sealing member having polytetrafluoroethylene resin immersed therein and fixed on at least one surface of said vane by sandwiching.

4. A rotary hydraulic actuator according to claim 2, wherein said sealing member covers the slidable portion of said vane which is in slidable contact with the inner curved wall, and includes, in proximity to the slidable portion, a thin skirt shaped projection which is formed to extend substantially along the inner curved wall so that one end of said sealing member which covers the slidable portion of said vane has a curved shape corresponding to the inner curved wall.

5. A rotary hydraulic actuator according to claim 4, wherein the sealing member is formed in a bag so as to be put on said vane.

6. A rotary hydraulic actuator according to claim 4, wherein the sealing member is formed with a vane body in a one-piece construction by insert molding.

7. A rotary hydraulic actuator according to claim 5, wherein the sealing member is formed with a vane body in a one-piece construction by insert molding.

* * * * *